US009605555B2

(12) United States Patent
Witz et al.

(10) Patent No.: US 9,605,555 B2
(45) Date of Patent: Mar. 28, 2017

(54) GAS TURBINE THERMAL SHROUD WITH IMPROVED DURABILITY

(71) Applicants: ALSTOM Technology Ltd, Baden (CH); Stefan Weber, Wettingen (CH)

(72) Inventors: Gregoire Etienne Witz, Birmenstorf (CH); Mathieu Esquerre, Neuenhof (CH); Michael Stuer, Niederrohrdorf (CH); Daniel Renusch, Baden (CH); Hans-Peter Bossmann, Lauchringen (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 385 days.

(21) Appl. No.: 14/249,489

(22) Filed: Apr. 10, 2014

(65) Prior Publication Data

US 2014/0308116 A1 Oct. 16, 2014

(30) Foreign Application Priority Data

Apr. 11, 2013 (EP) ..... 13163413

(51) Int. Cl.
*F01D 5/20* (2006.01)
*F01D 11/12* (2006.01)
*F01D 9/04* (2006.01)

(52) U.S. Cl.
CPC ..... *F01D 11/122* (2013.01); *F01D 9/04* (2013.01); *F05D 2230/642* (2013.01); *F05D 2240/11* (2013.01); *F05D 2300/21* (2013.01)

(58) Field of Classification Search
CPC .... F01D 11/122; F01D 9/04; F05D 2230/642; F05D 2240/11; F05D 2300/21
See application file for complete search history.

(56) References Cited

U.S. PATENT DOCUMENTS 3,690,785 A * 9/1972 Lind ..... F01D 11/005 277/364
4,728,257 A 3/1988 Handschuh
(Continued)

FOREIGN PATENT DOCUMENTS

CN 102042045 A 5/2011
CN 102748081 A 10/2012
(Continued)

OTHER PUBLICATIONS

Office Action (Notification of Reasons for Refusal) issued on Mar. 23, 2015, by the Japanese Patent Office in corresponding Japanese Patent Application No. 2014-81789, and an English Translation of the Office Action. (7 pages).
(Continued)

*Primary Examiner* — Jesse Bogue
(74) *Attorney, Agent, or Firm* — Buchanan Ingersoll & Rooney PC

(57) ABSTRACT

Shroud device thermally protecting a gas turbine blade, having a ceramic layer and a metallic layer, the metallic layer being thermally protected by the ceramic layer, the ceramic layer being mechanically joined to the metallic layer by a fixation device having a plurality of protrusions extending from the metallic layer designed so as to engage with a plurality of cavities located in the ceramic layer, such that there exists a gap between the cavities and the protrusions at ambient temperature, the gap disappearing at high temperature operation of the gas turbine, the protrusions being then locked into the cavities.

17 Claims, 3 Drawing Sheets

(56) References Cited

U.S. PATENT DOCUMENTS

| | | | | |
|---|---|---|---|---|
| 5,616,003 | A * | 4/1997 | Charbonnel | F01D 25/246 415/173.2 |
| 6,435,824 | B1 | 8/2002 | Schell et al. | |
| 6,652,227 | B2 * | 11/2003 | Fried | F01D 11/122 415/173.4 |
| 7,247,002 | B2 * | 7/2007 | Albrecht | F01D 5/147 415/200 |
| 7,278,820 | B2 * | 10/2007 | Keller | F01D 11/08 415/173.1 |
| 8,303,245 | B2 | 11/2012 | Foster et al. | |
| 8,303,247 | B2 * | 11/2012 | Schlichting | F01D 11/122 29/424 |
| 8,647,055 | B2 | 2/2014 | Foster et al. | |
| 2003/0170119 | A1 | 9/2003 | Fried | |
| 2007/0020105 | A1 | 1/2007 | Albrecht et al. | |
| 2009/0130424 | A1 | 5/2009 | Tholen et al. | |
| 2009/0169368 | A1 | 7/2009 | Schlichting et al. | |

FOREIGN PATENT DOCUMENTS

| | | | |
|---|---|---|---|
| EP | 1253294 | A2 | 10/2002 |
| EP | 2034132 | A2 | 3/2009 |
| JP | 2-196109 | A | 8/1990 |
| JP | 2008-297193 | A | 12/2008 |
| JP | 2009-41059 | A | 2/2009 |

OTHER PUBLICATIONS

Office Action (First Office Action) issued on Mar. 26, 2015, by the Chinese Patent Office in corresponding Chinese Patent Application No. 201410144093.5, and an English Translation of the Office Action. (16 pages).

European Search Report mailed on Sep. 18, 2013, for European Application No. 13163413.1.

* cited by examiner

GAS TURBINE THERMAL SHROUD WITH IMPROVED DURABILITY

FIELD OF THE INVENTION

The present invention relates to a shroud device used to thermally protect the blades of a gas turbine, the shroud device having improved durability.

BACKGROUND

The particularly strong conditions as to temperature and pressure that components in a gas turbine withstand make the material and the design of gas turbine components be of primary importance. Specifically, the blades of a gas turbine withstand strong operation conditions resulting in these blades being abraded with time. In order not to change the blades, which are very costly, every time they become abraded, it is known in the state of the art to use shroud devices that shield the blades, these devices being replaceable when needed in time.

Current shroud devices known in the state of the art consist of a metallic shroud having honeycombs embedded into it: typically, these honeycombs are composed of a thin metallic layer, having the problem that it oxidizes during the operation of the gas turbine, resulting in the shroud device being more brittle. For this reason, some solutions, as the one disclosed in U.S. Pat. No. 6,435,824 B2, replace the metallic honeycomb by a ceramic material, such as ceramic foam embedded in the metallic shroud. The main issue when using ceramic material (in foam or in any other way) is how to bind it to the metallic shroud configuring the shroud device, because of the thermal mismatch between ceramic materials and metallic materials, particularly super alloys used for gas turbine blades. The result is that, in these known solutions, high strain levels in the ceramic material occur during heating and/or cooling of the shroud device, ultimately resulting in the failure of the ceramic material and, therefore, in the failure of the shroud device.

Further solutions oriented to the reduction of strains due to the thermal mismatch of materials have been found and are known in the art: one of these solutions is a shroud device comprising a metallic shroud, a ceramic layer on top of it and a strain compliant layer between the metallic shroud and the ceramic layer. However, this strain compliant layer is ductile and has a limited strength: thus, for applications where a high level of shear (strain) stresses are applied to both the ceramic layer and the strain compliant layer, a compromise has to be found between the strain (shear) compliance and the strength, which is not easy to achieve.

Some other known solutions for attaching a ceramic material to a metal layer are brazing or, in case of a ceramic foam being used, by infiltration, as disclosed in U.S. Pat. No. 6,435,824 B2. However, all these known solutions present the drawback that any failure of the ceramic material requires the exchange of the whole shroud device, which is costly and time consuming. Another solution known is to fix the metallic layer and the ceramic layer by mechanical clamping: however, this solution results in stress accumulated in the ceramic layer, which can lead to the failure of it and, thus, of the complete shroud device.

The present invention is directed towards solving the above-mentioned drawbacks in the prior art.

SUMMARY OF THE INVENTION

The present invention relates to a shroud device used to thermally protect the blades of a gas turbine, the shroud device having improved durability. The shroud device of the invention comprises a ceramic layer and a metallic layer, the ceramic layer being mechanically joined to the metallic layer by a fixation device. In the shroud device of the invention, the ceramic layer is the part being abraded, the fixation device being designed in such a way that it allows the easy removal of the ceramic layer from the metallic layer, in order to have it replaced when needed. The shroud device is configured in such a way that the metallic layer is thermally protected by the ceramic layer, thus having minimized degradation kinetic. This configuration allows having thermal shroud devices with a high lifetime requiring only having the ceramic layer exchanged when needed, during the gas turbine engine opening.

BRIEF DESCRIPTION OF DRAWINGS

The foregoing objects and many of the attendant advantages of this invention will become more readily appreciated as the same becomes better understood by reference to the following detailed description when taken in conjunction with the accompanying drawings, wherein.

DETAILED DESCRIPTION OF THE INVENTION

Figure 1A:
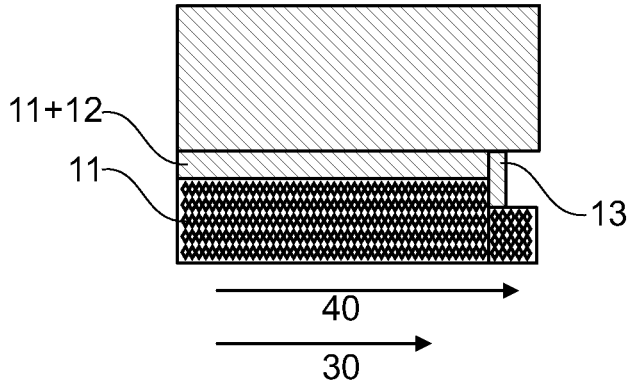
FIGS. 1*a* and 1*b* show schematic views of a shroud device having improved durability used to thermally protect the blades of a gas turbine, according to the present invention.
Figure 1B:
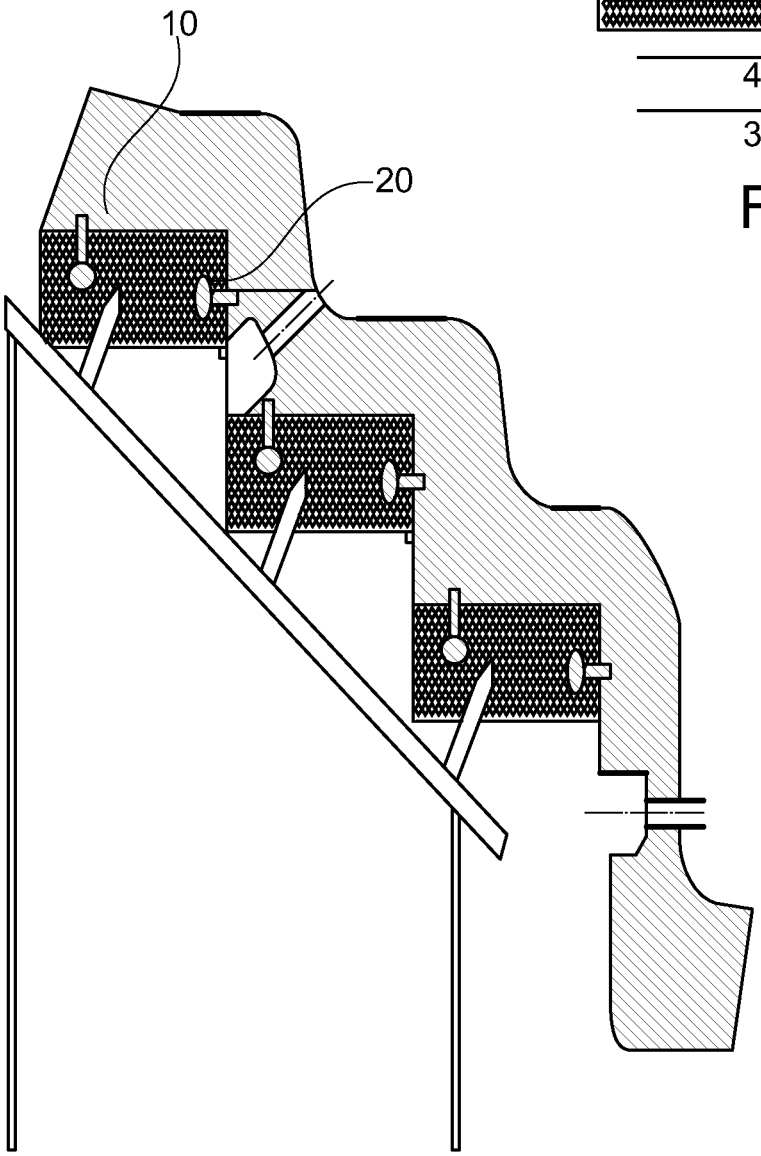

The present invention relates to a shroud device 10 thermally protecting a gas turbine blade, having improved durability. The shroud device 10 comprises a ceramic layer 11 and a metallic layer 12, the ceramic layer 11 being mechanically joined to the metallic layer 12 by a fixation device 20. The fixation device 20 is designed in such a way that it allows the easy removal of the ceramic layer 11 from the metallic layer 12, in order to have it replaced when needed. The metallic layer 12 is thermally protected by the ceramic layer 11, thus having minimized degradation kinetic, providing shroud devices 10 with a high lifetime requiring only having the ceramic layer 11 exchanged when needed, during the gas turbine engine opening.

The fixation device 20 of the invention allows the ceramic layer 11 to slide in and out of the shroud device 10 along the sliding in direction 30, so that the ceramic layer 11 can be easily replaced within the shroud device 10. A blocking device 13 does not allow the ceramic layer 11 to move further in the sliding direction 30 after its installation on the heat shield, defining the installed position of the ceramic layer 11. The blocking device 30 does not allow the ceramic layer 11 to move in the direction of the load applied by the gas turbine blade when rotating 40. The fixation device 20 is also designed in such a way that it holds in a tight manner the ceramic layer 20 during high temperature operation of the gas turbine blades, meaning that the fixation device 20 gets slightly loose (allows a certain degree of movement of the ceramic layer 11 with respect to the metallic layer 12) during rest position of the gas turbine blade and at ambient temperature.

The fixation device 20 comprises a plurality of protrusions 21 extending from the metallic layer 12 designed so as to engage with a plurality of cavities 22 located in the ceramic layer 11. According to the invention, the cavities 22 are slightly bigger than the protrusions 21, acting as counterparts, such as the surfaces of the cavities 22 and the protrusions 21 get in contact when the gas turbine is in operation and the ceramic layer 11 is in contact with hot gas having a temperature above 700° C.: (the temperature depends on the stage where it is installed, last stage blades will preferably have hot gas temperature ~700° C. or in the range from 700 to 1000° C., while first stage blades have hot gas temperature ~1500° C. and even higher. With this configuration, the ceramic layer 11 has no more free degree of movements with respect to the metallic layer 12 within the shroud device 10, with the exception of the movement 30 in the direction of insertion of the ceramic layer 11 into the metallic layer 12, this movement 30 being opposite to the shear movement 40 applied by the gas turbine blade when rotating.

The design of the shroud device 10 is made in such a way that the metallic layer 12 is thermally protected by the ceramic layer 11, acting as a heat shield, which ensures low degradation kinetic of this metallic layer 12 and high durability of this part of the shroud device 10, acting as an abradable system. Thanks to this configuration of the shroud device 10, after operation of the blades in the gas turbine with time, only the ceramic layer 11 has to be replaced, this being a task able to be performed by hand and on site.

The ceramic layer 11 can comprise ceramic foam. The material of the ceramic layer 11 will preferably comprise alumina, but can also comprise zirconia stabilized with yttria, calcia, magnesia or any combination thereof.

The porosity of the material in the ceramic layer 11 ranges between 20% and 80%, more preferably between 30% and 50%. The ceramic layer 11 can be manufactured by molding the material in a shape that, after firing it, leads to the desired size, requiring minimum machining for finishing the ceramic layer 11 to the required shape and dimensions. The porosity grade in the ceramic layer 11 can be obtained by using a fugitive material for tempering the ceramic, by introducing fugitive pore formers or by direct foaming of slurry.

Additionally, the ceramic layer 11 can be covered by an extra ceramic layer made of a material with a porosity of less than 30%: this extra ceramic layer will be located in the side of the ceramic layer 11 facing the hot gas, in order to reduce erosion. This extra ceramic layer can be manufactured by first molding a dense ceramic green body (a green material for ceramics is a material that has been shaped, and is made of the ceramic or a ceramic precursor and other materials like binders, being much softer than the final ceramic and can be easily machined; at this stage the ceramic is kept in shape by the binders, afterwards a high temperature heat treatment is performed, the binders are burned out and the ceramic grains sinter together to give the final product such that, during the sintering process, the volume of the ceramic body is decreasing meaning that the size and shape of the green body is not equal to the size and shape of the final product) in a thin layer, molding the green porous ceramic material precursor of the ceramic layer 11 independently, firing one or both of the materials independently, such that the sintering of both materials (dense ceramic and porous ceramic) is not complete and their size reduction during the last sintering step will match, assembling both materials together and performing the last sintering process. This allows ensuring that both materials will be strongly joined with a minimum of residual stresses at their interface.

Figure 2:
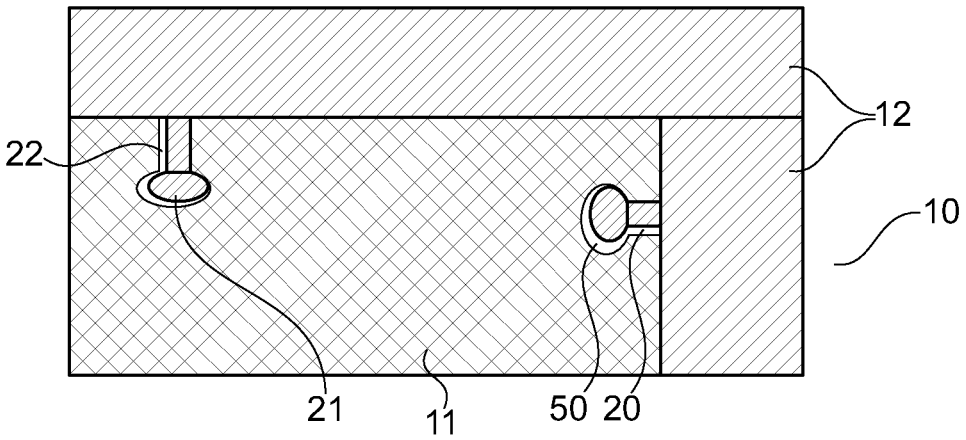
FIGS. 2 and 3 show schematic views of a shroud device having improved durability used to thermally protect the blades of a gas turbine, according to a first embodiment of the present invention.
Figure 3:
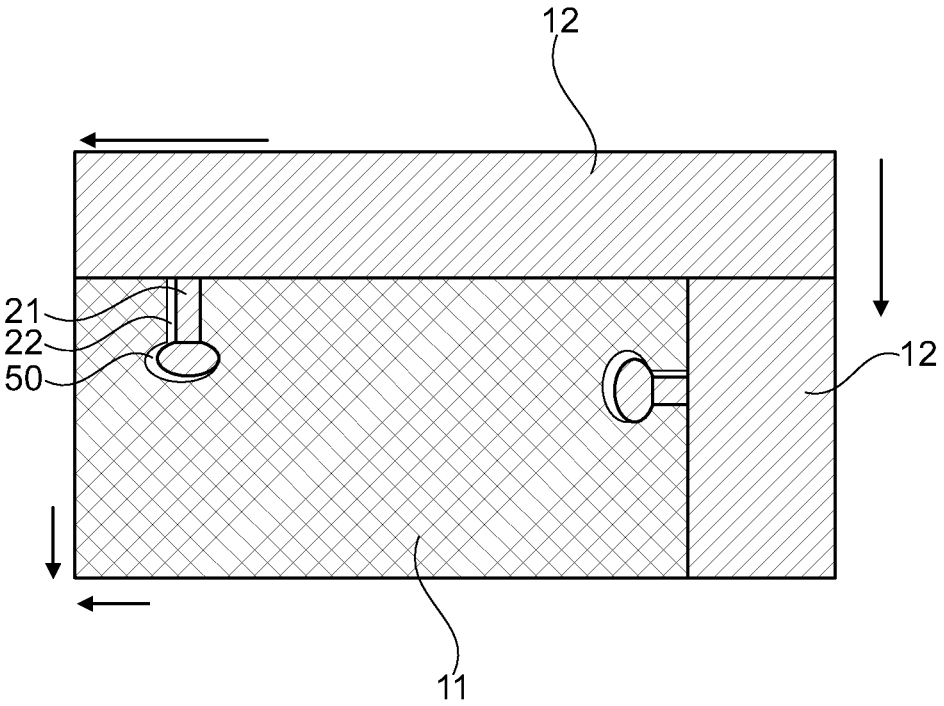

According to a first embodiment of the invention, as shown in FIGS. 2 and 3, the fixation device 20 is designed in such a way that the protrusions 21 extending from the metallic layer 12, matching with the cavities 22 in the ceramic layer 11, are substantially perpendicular between each other. As shown in FIGS. 2 and 3, there exists a gap 50 allowing a loose connection of the protrusions 21 and the cavities 22, at ambient temperature, the gap 50 being dimensioned such that when the high temperature is attained at operating conditions of the gas turbine, a tight lock of the protrusions 21 into the cavities 22 is obtained, the gap 50 then disappearing.

Figure 4:
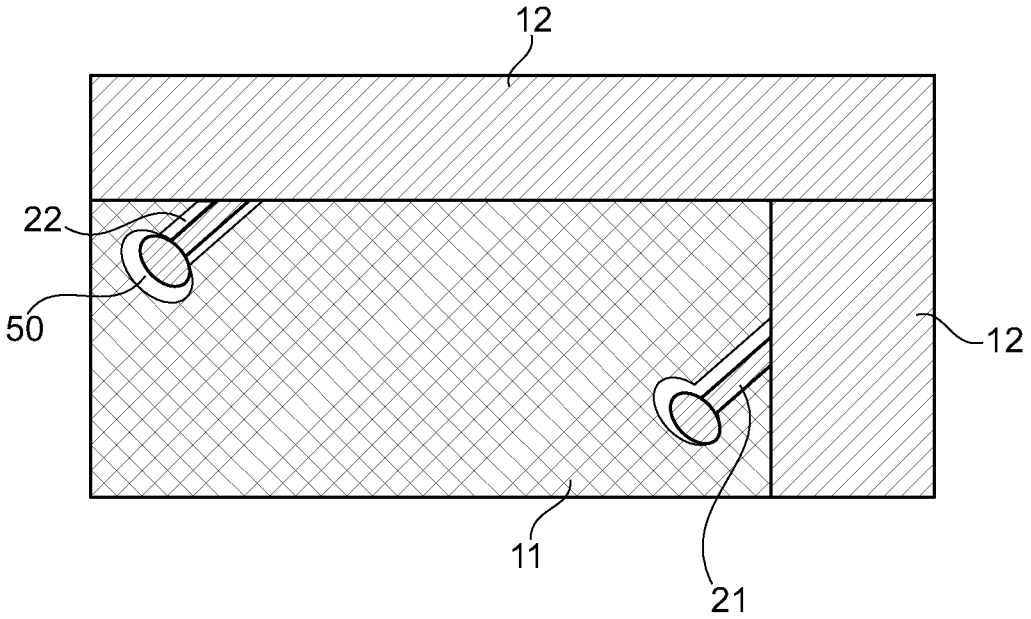
FIGS. 4 and 5 show schematic views of a shroud device having improved durability used to thermally protect the blades of a gas turbine, according to a second embodiment of the present invention.
Figure 5:
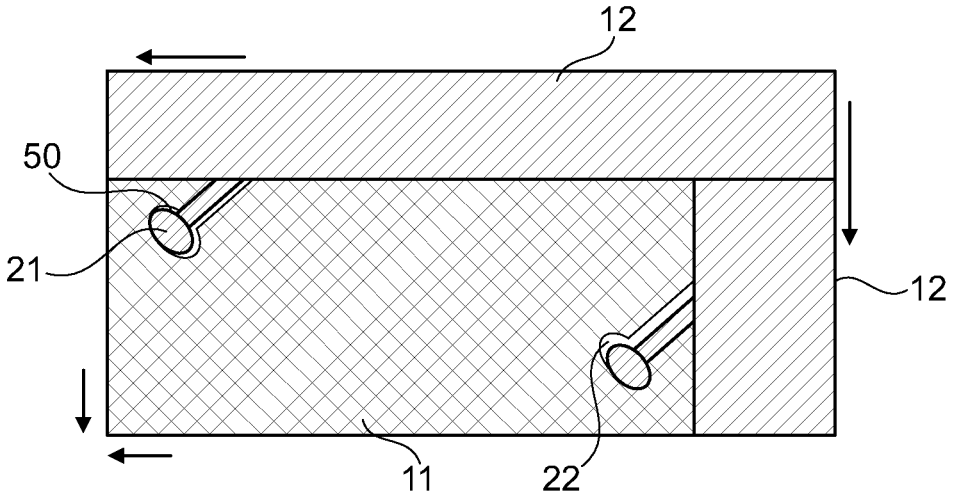

Similarly, according to a second embodiment of the invention, as shown in FIGS. 4 and 5, the fixation device 20 is designed in such a way that the protrusions 21 extending from the metallic layer 12, matching with the cavities 22 in the ceramic layer 11, are substantially parallel between each other, preferably forming an angle of around 45° with respect to the metallic layer 12 and the ceramic layer 11. As shown in FIGS. 4 and 5, there exists a gap 50 allowing a loose connection of the protrusions 21 and the cavities 22, at ambient temperature, the gap 50 being dimensioned such that when the high temperature is attained at operating conditions of the gas turbine, a tight lock of the protrusions 21 into the cavities 22 is obtained, the gap 50 then disappearing.

Although the present invention has been fully described in connection with preferred embodiments, it is evident that modifications may be introduced within the scope thereof, not considering this as limited by these embodiments, but by the contents of the following claims.

REFERENCE NUMBERS

10 shroud device
20 fixation device
11 ceramic layer
12 metallic layer
13 blocking device
21 protrusions of the metallic layer
22 cavities in the ceramic layer
30 insertion movement of the ceramic layer
40 shear movement produced by the rotation of the blades
50 gap between protrusions and cavities at ambient temperature

The invention claimed is:

1. Shroud device for thermally protecting a gas turbine blade, the shroud device comprising:

a ceramic layer; and a metallic layer, the metallic layer being thermally protected by the ceramic layer, the ceramic layer being mechanically joined to the metallic layer by a fixation device having a plurality of protrusions extending from the metallic layer configured to engage with a plurality of cavities located in the ceramic layer, such that a gap will exist between the cavities and the protrusions at a predetermined ambient temperature, the gap disappearing at a higher temperature operation of the gas turbine, the protrusions being then locked into the cavities, wherein the fixation device is configured such that the protrusions of the metallic layer, that are located in the cavities in the ceramic layer, are perpendicular to each other along the rotational axis of the turbine.

2. Shroud device according to claim 1, wherein the fixation device is configured to allow the ceramic layer to follow a directional movement in a direction of insertion and retrieval of the ceramic layer into/out of the metallic layer, the shroud device comprising:

a blocking device defining an installed position of the ceramic layer and restraining movement of the ceramic layer along the directional movement, this directional movement being parallel to a shear movement applied by a gas turbine blade when rotating.

3. Shroud device according to claim 1, wherein the ceramic layer comprises:

ceramic foam.

4. Shroud device according to claim 1, wherein the ceramic layer comprises:

alumina.

5. Shroud device according to claim 1, wherein the ceramic layer comprises:

zirconia stabilized with yttria, calcia, magnesia or any combination thereof.

6. Shroud device according to claim 1, wherein a porosity of material in the ceramic layer ranges between 20% and 80%.

7. Shroud device according to claim 1, wherein the porosity of the material in the ceramic layer ranges between 30% and 50%.

8. Shroud device according to claim 1, wherein a porosity grade in the ceramic layer is obtained with a fugitive material, by introducing fugitive pore formers or by direct foaming of slurry.

9. Shroud device according to claim 1, wherein the ceramic layer is covered by an extra ceramic layer made of a material with a porosity of less than 30%.

10. Gas turbine comprising:

at least one gas turbine blade; and a shroud device according to claim 1.

11. Shroud device according to claim 2, wherein the ceramic layer comprises:

ceramic foam.

12. Shroud device according to claim 2, wherein the ceramic layer comprises:

alumina.

13. Shroud device according to claim 2, wherein the porosity of the material in the ceramic layer ranges between 30% and 50%.

14. Shroud device according to claim 13, wherein a porosity grade in the ceramic layer is obtained with a fugitive material, by introducing fugitive pore formers or by direct foaming of slurry.

15. Shroud device according to claim 14, wherein the ceramic layer is covered by an extra ceramic layer made of a material with a porosity of less than 30%.

16. Shroud device for thermally protecting a gas turbine blade, the shroud device comprising:

a ceramic layer; and a metallic layer, the metallic layer being thermally protected by the ceramic layer, the ceramic layer being mechanically joined to the metallic layer by a fixation device having a plurality of protrusions extending from the metallic layer configured to engage with a plurality of cavities located in the ceramic layer, such that a gap will exist between the cavities and the protrusions at a predetermined ambient temperature, the gap disappearing at a higher temperature operation of the gas turbine, the protrusions being then locked into the cavities, wherein the protrusions extending from the metallic layer form an angle of 45° with respect to the metallic layer and the ceramic layer.

17. Shroud device according to claim 16, wherein the fixation device is configured such that the protrusions in the metallic layer, matching with the cavities in the ceramic layer, are parallel to each other.

* * * * *